US005176193A

United States Patent [19]

Yannazzone

[11] Patent Number: 5,176,193

[45] Date of Patent: Jan. 5, 1993

[54] VENETIAN BLIND SLAT CONSTRUCTION

[75] Inventor: Robert Yannazzone, Union, N.J.

[73] Assignee: Levolor Corporation, Sunnyvale, Calif.

[21] Appl. No.: 682,777

[22] Filed: Apr. 9, 1991

[51] Int. Cl.[5] ..... E06B 9/30

[52] U.S. Cl. ..... 160/168.1

[58] Field of Search ..... 160/236, 176.1, 168.1, 160/166.1

[56] References Cited

U.S. PATENT DOCUMENTS 4,739,816 4/1988 Dodich et al. ..... 160/168.1

FOREIGN PATENT DOCUMENTS 9102879 3/1991 PCT Int'l Appl. ..... 160/168.1

1044871 10/1966 United Kingdom ..... 160/176.1

*Primary Examiner*—Blair M. Johnson

*Attorney, Agent, or Firm*—Skjerven, Morrill, MacPherson, Franklin & Friel

[57] ABSTRACT

A venetian blind (10) includes a headrail (11), a series of horizontal slats (12), a bottom rail (18) and lift cords (14) to raise and lower the slats and bottom rail, the slats each including spaced marquise shape apertures (22), called rout holes, through which a lift cord (14) passes. The spaced elliptical apertures are of less width and less length than the conventional rout holes heretofore employed. A substantial reduction of visible light through the apertures is achieved in the slats-tilted-closed position by a reduction of about 73% in the light-passing open space between the lift cord and the rout hole edges. The smaller size of the rout holes increases the structural rigidity and integrity of the remaining slat portions next to the rout holes and reduces the visual defect of the larger holes.

10 Claims, 1 Drawing Sheet

VENETIAN BLIND SLAT CONSTRUCTION

CROSS REFERENCE TO RELATED APPLICATION

This application relates to U.S. Ser. No. 355,036 filed Jul. 17, 1989, now abandoned and a continuation thereof U.S. Ser. No. 07/640,568 filed Jan. 14, 1991 now abandoned entitled Window Blinds made by the inventor hereof.

BACKGROUND OF THE INVENTION

1. Field of the Invention

This invention pertains to venetian blinds employing a window-mounted headrail, a series of horizontal blind slats and bottom rail with an arrangement of lift cords passing through slat apertures to raise and lower the slats and bottom rail and to retain the slats in a vertically stacked relationship regardless of the position of the blind with respect to the window. More particularly, the invention is directed to an improvement of the apertures in the slats through which the lift cords pass, specifically to the shape and relative size of the apertures resulting in the reduction of light passing through the assemblage of blind slats.

2. Material Art

The related application is directed to the positioning of slat apertures immediately adjacent to the slat ends and also discloses a typical prior art blind where the slat apertures are well inboard of the slat ends at the same lateral position as the tilt ladders normally associated with a venetian blind. In both cases, the slat apertures, sometimes referred to as "rout holes" are typically rectangular in shape and extend medially of the slats over about one-half of the slat width. The corners of the ends of the rectangular slot may be rounded. Illustrative of the rectangular slots, apertures or rout holes is U.S. Pat. No. 4,739,816 (FIG. 8) and a myriad of commercial venetian blinds seen in the marketplace.

Since the primary function of a venetian blind is to provide light control, it is desirable that the blind allow as little light seepage as possible, not only by means of orienting the angle of the slats to the light (typically by use of tilt ladders and tilt control mechanisms in the headrail operable by a tilt wand), which is controllable feature of a blind, but also between the ends of the slats and the window mullions, the head channel and the slats, and the bottom rail and the window sill.

Light seepage also occurs at the point of the rout holes. In the past, there have been many attempts to reduce the size of the apertures so as to reduce light passage. However, since the rout holes must provide free and unencumbered passage of the lift cords through the slats, regardless of the slat's angle of tilt, the rout holes are typically rectangular in shape, and have a uniform opening sufficiently wide for the lift cord's passage.

FIG. 3 hereof illustrates a typical prior art rout hole which in a nominal one inch (2.46 cm.) wide slat has a longitudinal length l of about 1.10 cm. and a width w of about 0.30 cm. with an open area A of about 0.312 $cm^2$. It is medially spaced a distance d of about 0.79 cm from each of the edges of the slat.

A typical woven nylon or polyester lift cord 14 of 0.127 cm. is employed, as illustrated, which blocks out light particularly in the slat-tilted-closed position but still leaves an area B on both sides of the cord 14 parallel to the rout hole parallel edges 50 of approximately 0.185 $cm^2$. These relatively wide areas in each vertical row (typically two or three in number) of the series of slats results in a high degree of light penetration through each of the areas B. The width of the prior art rout holes relative to the diameter of the lift cord also results in considerable lateral movement of the slats causing a degree of misalignment of the edges of the series of slats. Further, due to the size of the prior art rout holes and the need to retain structural rigidity and strength at the slat-weakening rout hole, a relatively high slat material gage thickness has been required. Typically in a 2.46 cm wide aluminum slat a gage thickness of about 0.017 cm has been employed.

Typically, as a hole is punched in precoated (painted) slat material, the walls of the punched holes are left as a bare, uncoated surface. The greater the material gage and the larger the rout hole, the more apparent the unfinished edge. This situation is magnified when the hole is punched in darker colored material. In an assembled blind, the uncoated surface reflect light and accent the vertical lines caused by the rout holes.

SUMMARY OF THE INVENTION

The present invention very substantially reduces the area through which light can be transmitted through the slat apertures or rout holes as compared to the standard rectangular rout holes. This is accomplished by changing both the size and shape of the slat apertures. In the disclosed embodiment the reduction of the light-passing area is approximately 73%. The rout hole construction is elliptical in shape, with essentially pointed ends. This shape generally may be termed to be marquise or marquee aperture named after the gem or ring setting of elliptical shape with pointed ends. In the case of a 2.54 cm wide slat, the pointed end of the apertures make a short radius of curvature of the order of about 0.051 while curved side sections, connecting those curved end sections, have a radius of curvature of the order of about 1.17 cm when a 1.27 cm diameter lift cord is employed. The relationship between the diameter of the lift cord and the dimensions of the elliptical rout hole are proportionate and thus the invention is not limited to an exact diameter or rout hole size. The pointed ends of the elliptical rout holes assist in the repositioning of the slats each time the blind is partially or fully tilted closed.

Reduction in the average width of the rout hole, particularly of the area B' between the cord and the route hole edges, results in a decreased passageway through which the lift cord can pass. This desirably restricts lateral movement of each slat in the stack of slats. Further, the reduction in the average length of the slat apertures substantially increases the rigidity of the slat by increasing the length of remaining slat material from the lateral edge of the slat to the pointed end of the slat rout hole. Additionally, as compared to the prior art rout holes illustrated in FIG. 3, the visual defect caused by the unfinished interior surface of a punched-out rout hole and light reflection therefrom is minimized. In the event the slats include pinhole perforations throughout the slat, the reduced size of rout holes in the slat promotes greater structural integrity while limiting the visual distraction caused by the disproportionately larger holes. The small rout holes of the invention provide improved aesthetics and reduce light seepage through the rout holes, particularly rout holes positioned at or adjacent to the center of the blind, thus improving the blind's solar, optical and light transmission properties.

DETAILED DESCRIPTION

Figure 1:
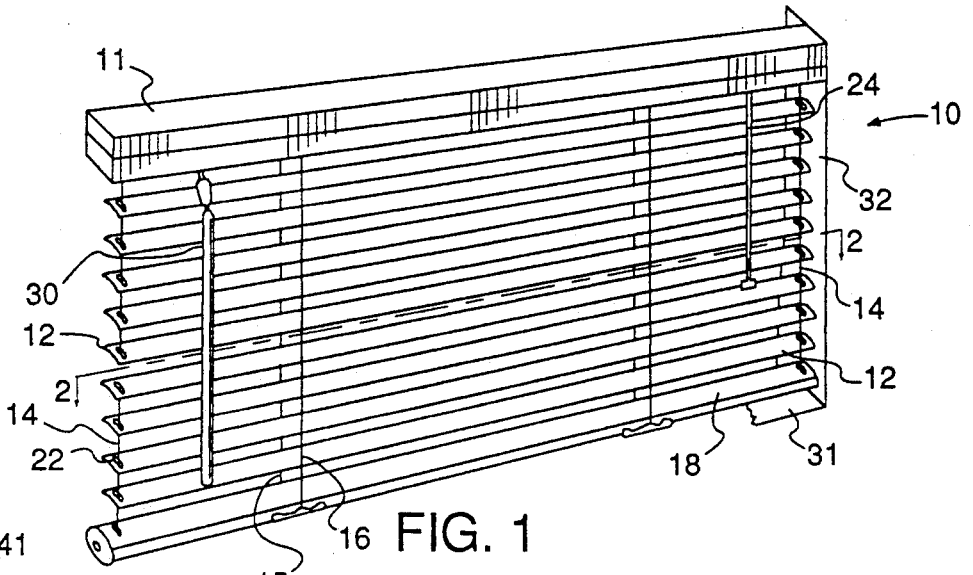
FIG. 1 is a perspective view of a venetian blind incorporating the invention.

The invention is seen in FIG. 1 where a venetian blind 10 includes a headrail 11, a series of horizontal tilt slats 12 depending therefrom, a bottom rail 18 and lift cords 14 at each end (and also at the middle or other spaced positions in blinds of relatively large width). The lift cords pass through elliptical apertures 22 (rout holes), in each of the slats. The blind is lowered or raised by pulling on a loop or number of lift cord ends 24 extending from a lock mechanism (not shown) in the headrail to a fixed position in the bottom rail. Tilting of the slats 12 in unison is performed by rotation of a tilt wand 30 through approximate gearing, tilt drums (not shown) in the headrail. Tape or threaded/woven tilt ladders 20 having vertical ladder legs 15,16 and horizontal ladder rungs extending under each slat, are provided as is well known in the art. Each of the rout holes 22 in accord with the present invention are elliptical in shape and are of a smaller average width and smaller length then the rectangular rout roles of the prior art. The blind 10 is normally mounted by a mounting clip or screws (not shown) in a window space formed by a window sill 31 and the window mullions 32.

Figure 2:
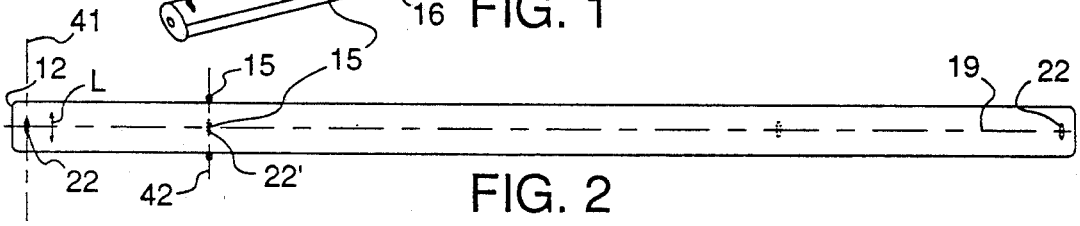
FIG. 2 is a plan view of a single blind slat taken the line 2—2 of FIG. 1.

FIG. 2 shows the spacing, shape and orientation of the rout holes 22 in a single slat 12. The rout holes may be placed at a slat-end position 41 as in the related application or at a conventional position 42 at the same location as the tilt ladders 20. In FIG. 2 these alternative positions are denoted as rout holes 22'.

The rout holes 22 (or 22') extend over a medial distance transverse to the longitudinal axial length of the slat along axis 19, a distance L of from about 30% to about 40% of the width of the slat, preferably about 35%. This minimizes the detrimental effect of having a structural weakened cross-section in the slat at the rout hole location.

Figure 4:
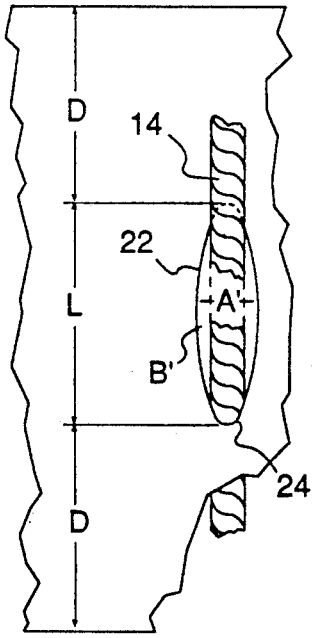
FIG. 4 is a schematic top view of the size and shape of the rout hole of the invention with the lift cord and slat in a slat-tilted-closed position.

FIG. 4 illustrates the very substantial lessening of the overall rout hole area A' and light passage area B' in the slats-closed position resultant from the use of the invention. The lift cord 14 passes through rout hole 22 with a diametric surface touching the hole edges approximate the junction of the pointed end sections 24 and the side sections 26 of the elliptical rout hole 22.

Figure 3:
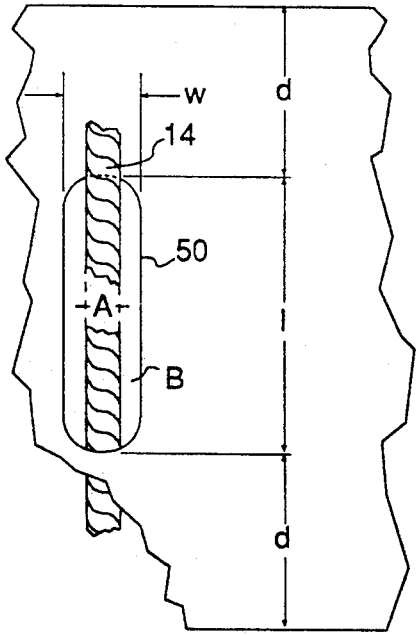
FIG. 3 (PRIOR ART)
FIG. 3 is a schematic top view showing the size and scope of a typical prior art rout hole and lift cord in a slat-tilted-closed position.
Figure 5:
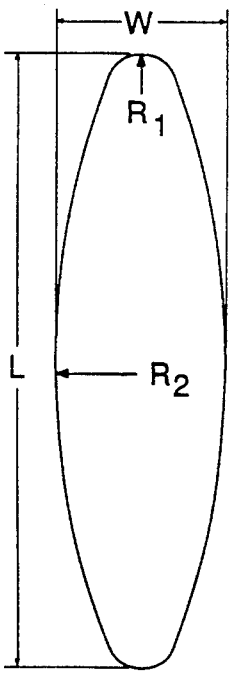
FIG. 5 is a detailed blow-up view of the size and shape of the rout hole per se of the invention.

FIG. 5 illustrates an embodiment where the rout hole length L is about 0.88 cm and the rout hole width W is about 0.24 cm for use in a 2.46 cm aluminum blind slat. The elliptical-shaped rout holes are typically punched out in the aluminum slat at spaced positions by a suitable tool die (not shown). In this embodiment the pointed end sections 24 have a radius of curvature $R_1$ of about 0.051 cm. while the curved side sections 26 connecting the end sections have a radius of curvature $R_2$ of about 1.17 cm. As compared to the FIG. 3 prior art the length of the rout hole for the same slat width is lessened by 0.22 cm. and the largest width is lessened by 0.06 cm. The radius of curvature of the pointed end sections is preferably in the range of from about 0.04 to about 0.06 cm and the radius of curvature of the side sections a range of from about 1.00 cm to about 1.30 cm.

The above description of an embodiment of this invention is intended to be illustrative and not limiting. Other embodiments of this invention will be obvious to those skilled in the art in view of the above disclosure.

I claim:

1. A venetian blind including a headrail; a series of horizontal tiltable slats depending from the headrail; a bottom rail; means including circular in cross-section lift cords for raising and lowering the slats and bottom rail, each of said slats including at least two spaced slat apertures through which the lift cords pass, and wherein said slat apertures are essentially of a marquise shape with pointed ends and connecting side sections, each of said lift cords having a diameter greater than one-half the maximum width of the essentially marquise-shaped slat apertures taken on their minor axis and in a slots-tilted closed position having a diametric surface touching the slat aperture approximate the junction of the pointed ends and the side sections, such that a substantial reduction of visible light through the slat apertures is obtained in the slats-tilted closed position.

2. The venetian blind as set forth in claim 1 wherein said slat apertures have pointed end sections having a radius of curvature of from about 0.4 cm to about 0.6 cm and side sections connecting said end sections, said side sections having a radius of curvature from about 1.00 cm to about 1.3 cm.

3. The venetian blind as set forth in claim 1 wherein said slat apertures have pointed end sections having a radius of curvature of about 0.5 cm and side sections connecting said end sections, said side sections having a radius of curvature of about 1.17 cm.

4. The venetian blind as set forth in claim 1 in which a longitudinal length of said slat apertures is transverse to a longitudinal length of said slats and extends medially over from about 30% to about 40% of the width of the said slats.

5. The venetian blind as set forth in claim 1 in which said slat apertures have a longitudinal length transverse to a longitudinal length of said slats and extends medially over about 35% of the width of said slats.

6. A venetian blind slat of elongated generally rectangular shape and having at least two spaced slat apertures extending therethrough for passage of a circular in cross-section blind draw cord, said slat apertures being essentially of a marquise shape with pointed ends and connecting side sections and wherein a diametric surface of the cord in the slots-tilted closed position touches the slat aperture approximate the junction of the pointed ends and the side sections and such that the draw cord fills up a majority of the open area of each aperture when said slat is tilted into general parallelism with the draw cord, and the draw cord passing through a slat aperture substantially obscures light from passing between diametrical edges of the draw cord and peripheral edges of said marquise shape defining the slat apertures.

7. The blind slat of claim 6 wherein said slat apertures have pointed end sections having a radius of curvature of from about 0.04 cm to about 0.06 cm and side sections connecting said end sections, said side sections having a radius of curvature from about 1.00 cm to about 1.3 cm.

8. The blind slat of claim 6 in which a longitudinal length of said slat apertures if transverse to a longitudinal length of said slats and extends medially over from about 30% to about 40% of the width of said slats.

9. A venetian blind including a headrail; a series of tiltable horizontal slats depending from the headrail; a bottom rail; means including lift cords for raising and lowering the slats and bottom rail, each of said slats including at least two spaced apertures through which the lift cords pass; wherein said slat apertures are essentially elliptical in shape such that a substantial reduction of visible light through the slat apertures is obtained in the slats-tilted position; in which said slat apertures have a marquise shape having curved pointed ends extending transversely of the longitudinal length of said slats and wherein said lift cords are circular in cross-section and the radius of curvature of said pointed ends is less than half the diameter of said lift cords.

10. The venetian blind as set forth in claim 9 wherein said slat apertures have side sections connecting said pointed ends, said side sections having a radius of curvature such that the side sections have a width approximate to their connection to said pointed ends essentially the same as the diameter of said lift cords and a medial width greater than the diameter of said lift cords.

* * * * *

UNITED STATES PATENT AND TRADEMARK OFFICE

CERTIFICATE OF CORRECTION

PATENT NO. : 5,176,193

DATED : January 5, 1993

INVENTOR(S) : Robert Yannazzone

It is certified that error appears in the above-indentified patent and that said Letters Patent is hereby corrected as shown below:

Col. 2, line 38, after "0.051", insert --cm--;

Col. 2, line 40, delete "1.27 cm" and substitute --0.127 cm--;

Col. 4, line 32, delete "0.4 cm" and substitute --0.04 cm--;

Col. 4, line 32, delete "0.6 cm" and substitute --0.06 cm--;

Col. 4, line 38, delete "0.5 cm" and substitute --0.05 cm--.

Signed and Sealed this

Tenth Day of May, 1994

Bruce Lehman

*Attest:*

BRUCE LEHMAN

*Attesting Officer*

*Commissioner of Patents and Trademarks*